US006165145A

United States Patent [19]

Noble

[11] Patent Number: 6,165,145

[45] Date of Patent: Dec. 26, 2000

[54] BODY MASSAGER

[75] Inventor: Edward D. Noble, Unionville, Canada

[73] Assignee: Wellness Innovations Corp., Markham, Canada

[21] Appl. No.: 09/244,650

[22] Filed: Feb. 4, 1999

[51] Int. Cl.[7] ..... A61H 23/00; A61H 23/06

[52] U.S. Cl. ..... 601/111; 601/97; 601/103; 601/107; 601/108

[58] Field of Search ..... 601/46, 67–70, 601/72–74, 89, 93–95, 97, 101–103, 108, 107, 110, 111, 128–130, 78–81, 141; D24/211, 214, 215; 606/204

[56] References Cited

U.S. PATENT DOCUMENTS

| | | | |
|---|---|---|---|
| D. 264,754 | 6/1982 | Vitrac | D24/211 |
| 4,069,816 | 1/1978 | Yamamura et al. | 601/107 |
| 4,079,733 | 3/1978 | Denton et al. | 601/108 |
| 4,549,535 | 10/1985 | Wing | 601/108 |
| 4,716,898 | 1/1988 | Chauve et al. | 601/135 |
| 4,730,605 | 3/1988 | Noble et al. . | |
| 4,733,655 | 3/1988 | Smal | 601/135 |
| 4,841,955 | 6/1989 | Evans et al. | 601/108 |
| 5,140,979 | 8/1992 | Nakagawa | 601/108 |
| 5,158,073 | 10/1992 | Bukowski | 601/135 |
| 5,618,315 | 4/1997 | Elliott | 601/108 |
| 5,716,332 | 2/1998 | Noble . | |
| 5,803,916 | 9/1998 | Kuznets et al. | 601/112 |
| 5,893,836 | 4/1999 | Raines | 601/69 |

FOREIGN PATENT DOCUMENTS

| | | | |
|---|---|---|---|
| 405228194 | 9/1993 | Japan | 601/107 |
| 1292773 | 2/1987 | U.S.S.R. | 601/111 |

*Primary Examiner*—Justine R. Yu
*Attorney, Agent, or Firm*—Bereskin & Parr

[57] ABSTRACT

A body massager having a casing that is of generally T-shaped configuration overall with a slender elongate handle and an enlarged portion at an inner end of the handle having an overhanging transverse hand grip. A massage head below the grip has a pair of generally dome-shaped massage formations that vibrate towards and away from a surface to be massaged. Each formation has a base element and a replacement cover that is made of a non-foam material such as PVC. The cover has a wall structure that includes a plurality of cavities and intervening wall portions that extend in the direction in which the massage formation moves during massage, so that the wall portions deform and restore for providing resiliency of the massage formation.

9 Claims, 6 Drawing Sheets

FIG.9.
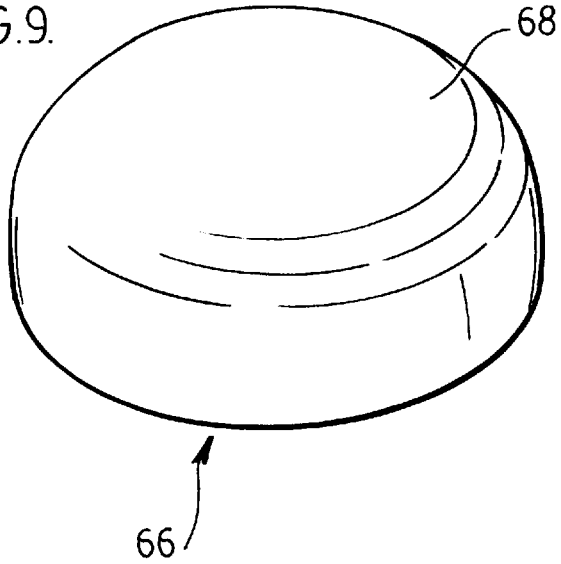
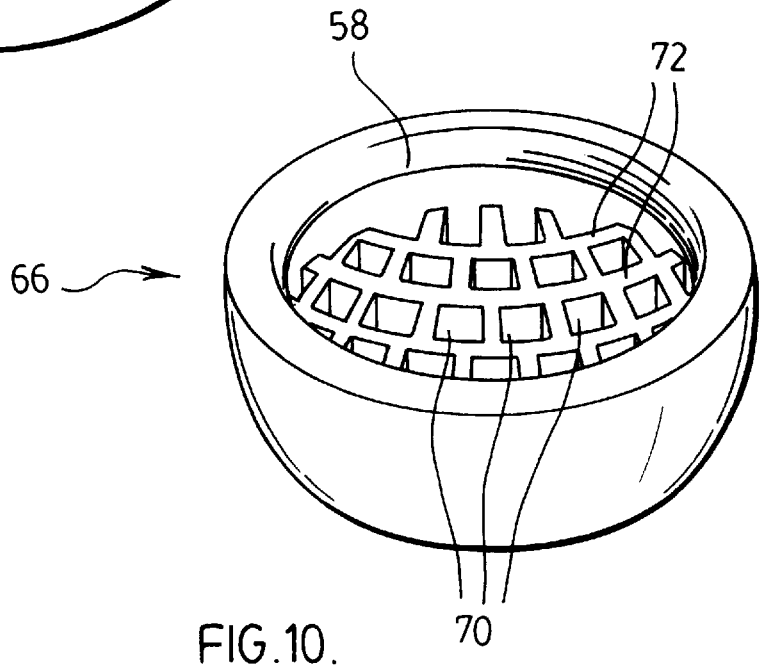
FIG.10.

BODY MASSAGER

FIELD OF THE INVENTION

This invention relates generally to power-operated body massagers of the type which provide a percussive massage effect.

BACKGROUND OF THE INVENTION

Traditionally, doctors, chiropractors and other professional therapists have used power-operated massagers to give treatment that involves manipulation of body structures. Therapy of this type has been found particularly effective in treating muscle tension and fatigue, for example in athletes. In recent times, power-operated body massagers for home use, have come into vogue.

DESCRIPTION OF THE PRIOR ART

U.S. Pat. No. 5,716,332 (Noble) discloses an example of a percussive massager that is designed so as to be capable of use for self massage. In other words, the person operating the massager can use it on his or her own body. An example of a percussive massager intended to be used by a massage therapist for treating another person is shown in U.S. Pat. No. 4,730,605 (Noble, et al.).

Typically, a percussive massager has a massage head that includes at least one massage formation of generally hemispherical form that moves towards and away from the surface being massaged when the massager is operated, thereby exerting a percussive massage effect. Two massage formations may be provided on a "rocker" structure that oscillates about an axis between the formations when the massager is operated. The massage formations then act alternately on the surface being massaged. Massage heads of this type are shown in both of the patents referred to previously. In the '332 patent, the rocker structure has two massage formations only, while in the '605 patent, massage formations in groups of four are provided on opposite sides of the rocker axis.

A challenge in designing a massager having massage formations of the type described is to provide the formation with some resiliency, so that the massage effect is not too severe; at the same time, the formation must be durable in the sense that it will not break down under the repeated compressive forces to which it is subjected when the massager is in use.

Early designs used foam rubber hemispheres—essentially foam rubber balls cut in half. While these structures achieve the required resiliency, the surface of the foam rubber would tend to shred over a period of time, so the required durability was not achieved. The cavities or cells in the foam rubber break down under the effect of compression and restoration of the foam rubber during massage. Attempts to make massage formations using self-skinning urethane foam generally provided a satisfactory product. However, the formations had to be poured by hand and therefore were very costly to make.

The '332 patent supra discloses a further attempt to address the problem by using a three-layer structure comprising a rigid base element, an outer cover which is removably coupled to the base element, and a separate and replaceable intermediate cushion member between the base element and the cover. The cover could provide a tough (e.g. rubber) "skin" on the massage formation while the required resiliency is provided by the cushion member. Since the cushion member is protected by the cover, it can be foam rubber.

An object of the present invention is to provide a simplified structure for the massage formation, while addressing these issues in the prior art.

SUMMARY OF THE INVENTION

In one aspect, the invention provides a body massager that includes a base structure having at least one handle for permitting the massager to be held by a user and manipulated in use and a massage head for providing percussive massage. The massage head includes at least one massage formation of generally hemispherical form and is coupled to the base structure for permitting movement of the massage formation in a direction towards and away from a notional plane representing a surface to be massaged, for exerting a percussive massage effect. The massager also includes drive means acting between a base structure and the massage head and operable to cause the required movement of the massage formation. The massage formation includes a base element having an outer surface that moves towards and away from the notional plane when the drive means is operated, and a cover which is coupled to the base element so as to cover said outer surface. The cover is made of a non-foam material having a plurality of cavities and intervening wall portions extending in the said direction in which the massage head moves towards and away from said notional plane, so that the wall portions deform and restore during massage for providing resiliency of the massage formation.

In summary, the massage formation provided by the invention achieves resiliency primarily due to the wall structure of the cover, namely the cavities and intervening wall portions. While some resiliency may be derived from the material of the cover, the characteristics of the material do not primarily provide resiliency. The cover should be of a non-foam material, in order to avoid the shredding problem referred to previously. Polyvinyl chloride (PVC) is an example of a material that can be used for the cover; other suitable materials will be apparent to a person skilled in the art.

The resiliency characteristics of the cover can be "engineered" within quite wide limits by varying the size, distribution and shape of the cavities, and the thickness and height of the intervening wall portions. Preferably, the cover is removably coupled to the base element so that it can be readily removed and replaced. The user can then be provided with a range of covers having different resiliency characteristics so that the massage characteristics of the massager can be varied according to the desired massage effect.

The cavities in the cover could in principle open into the outer surface of the cover but normally the cavities will open internally. The outer surface of the cover can be smooth and generally hemispherical or dome-shaped. Alternatively, the external surface of the cover can be contoured, for example to provide a tire tread-like "look" to the cover. In other words, the surface of the cover may be provided with an array of tread-like protrusions, the outer surfaces of which would actually act on the surface to be massaged, possibly providing some enhancement to the massage effect, e.g. by a "kneading" action. The protrusions could be hollow for providing the cavities within the wall structure of the cover.

BRIEF DESCRIPTION OF DRAWINGS

In order that the invention may be more clearly understood, reference will now be made to the accompanying drawings which illustrate a particular preferred embodiment of the invention by way of example, and in which:

FIG. 9 is a perspective view showing the exterior of an alternative form of cover; and, FIG. 10 is an internal perspective view of the cover shown in FIG. 9.

DESCRIPTION OF PREFERRED EMBODIMENTS

Figure 1:
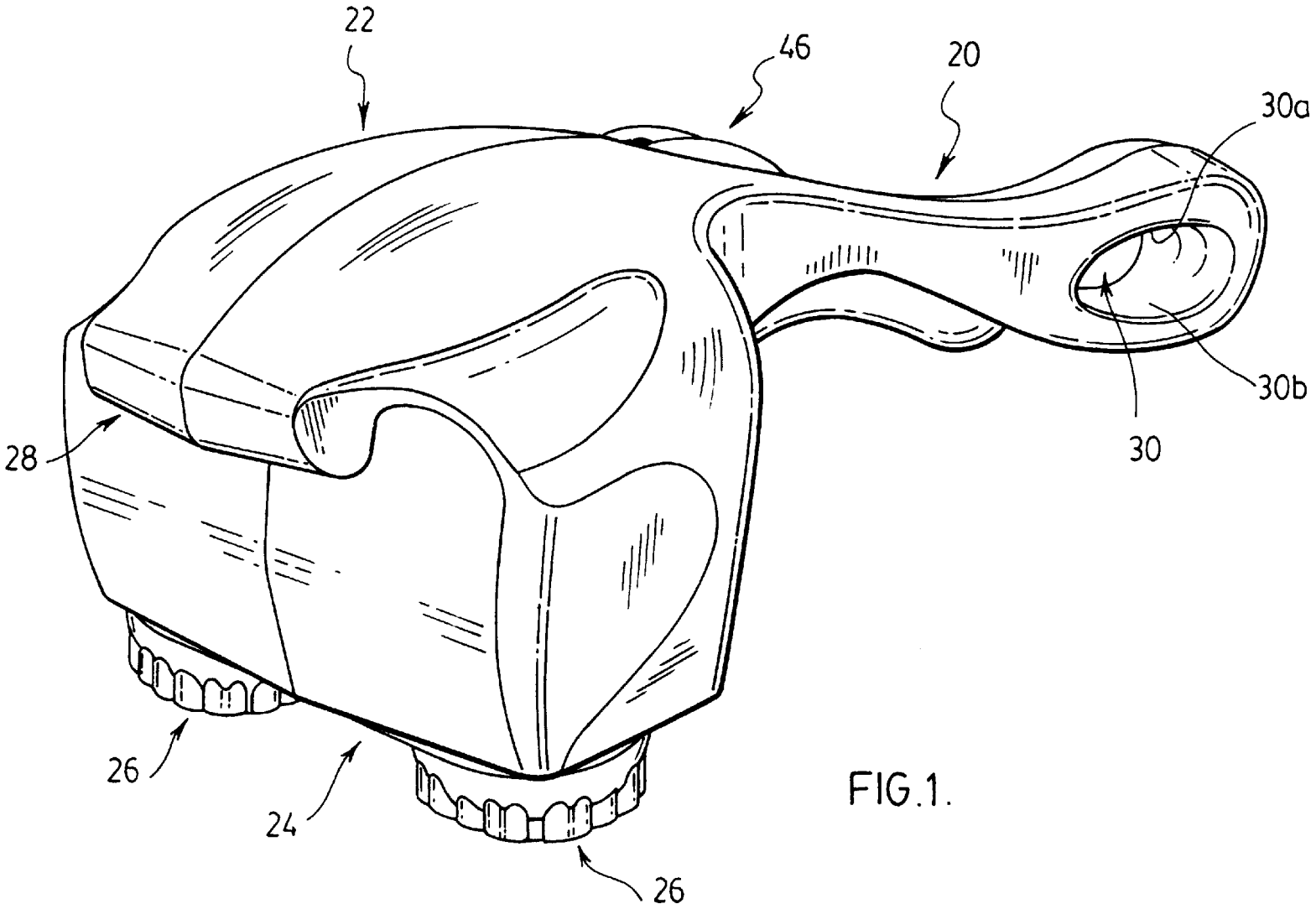
FIG. 1 is a perspective view from one end of a body massager in accordance with the invention.
Figure 2:
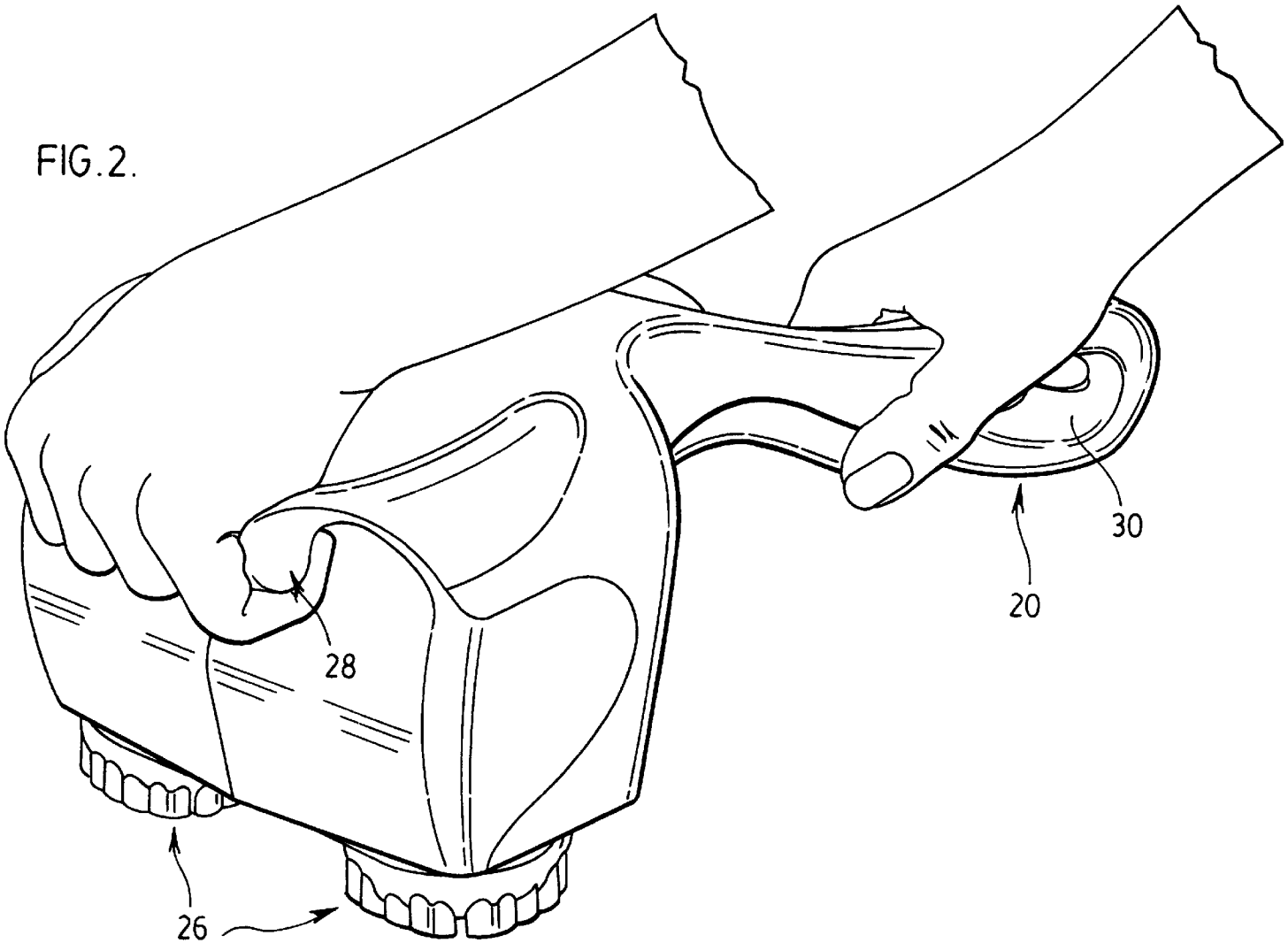
FIG. 2 is a view similar to FIG. 1 showing the massager in use.
Figure 3:
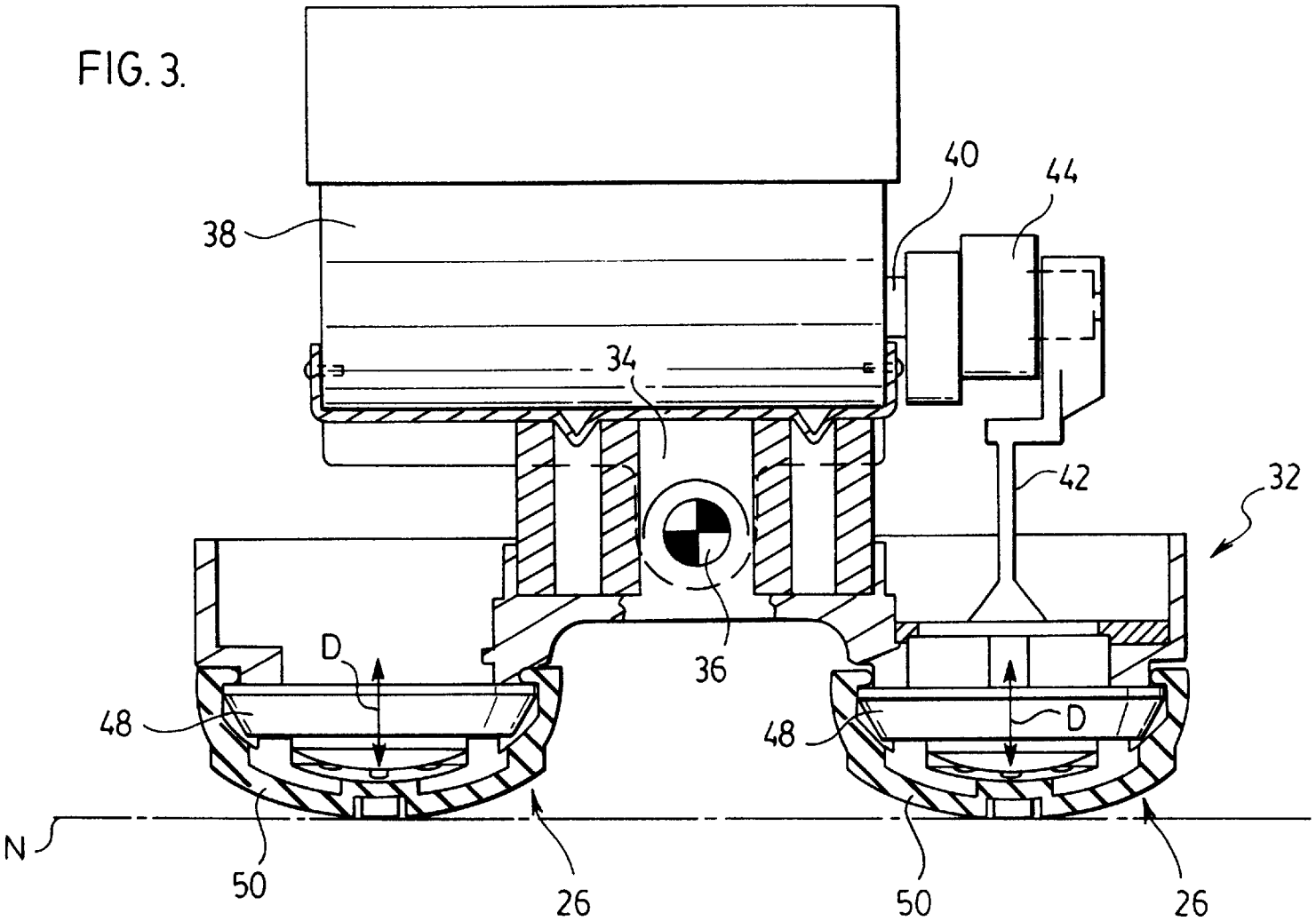
FIG. 3 is a generally vertical sectional view through the massager shown in FIGS. 1 and 2, at the position of the massage formation.

FIGS. 1 to 3 show a body massager of the general type disclosed in U.S. Pat. No. 5,716,332 (supra). Accordingly, reference may be had to that patent for details of the overall structure and constructional details of the massager. Since the present invention relates primarily to the design of the massage formations of the massager, in the present disclosure, emphasis is placed on those portions of the massager. The disclosure of the '332 is incorporated herein by reference.

The drawings show a "self-use" body massager designed for one-handed operation by the person receiving the massage, although there is of course no limitation to use in this fashion. It should be understood that this form massager is illustrated by way of example only and that the massage formations provided by the invention may be applied to any form of percussive massager. Another example is that shown in the U.S. Pat. No. 4,730,605 patent (supra). The invention could even be applied to the massager having only a single massage formation.

Reverting to the drawings, FIG. 1 shows that the massager has a generally T-shaped configuration overall with a slender elongate handle 20 and enlarged transverse portion 22 at one end. As disclosed in the '332 patent, the massager includes a base structure having a casing that defines the handle and the enlarged end portion. A massage head 24 is provided at the lower end of the enlarged portion 22 of the casing and includes two massage formations 26.

A hand grip formation 28 is provided on the casing above the massage head 24 and extends generally at right angles to handle 20, so that the massager can be conveniently held and manipulated in use as shown in FIG. 2 with one of the user's hands holding the formation 28 and the other holding the handle 20. The massager can also be used one-handed, typically by holding only the handle 20. It will be seen that the handle has an opening 30 through which a user's fingers can extend. The opening has top and bottom surfaces 30*a*, 30*b* which are flat in cross-section and against which the user's fingers can lie for enhanced control in manipulating the massager. For example, the user can hold the massager in one hand with his or her fingers extending through the opening 30 and in contact with one of the flat surfaces 30*a*. The user can then bring the arm of that hand over the opposite shoulder, so that the massager can be used on the person's back. Flat surfaces allow good control and, for example, permit twisting the massager in use.

FIG. 3 is a schematic rendition of massage head 24 and drive means of the massager, essentially taken from the '332 patent. Reference may be had to that patent for full details of the structure and drive arrangement.

Briefly, the two massage formations 26 are carried by a rocker element 32 that is pivotally coupled to a bracket 34 forming part of the base structure of the massager, so that the rocker can oscillate about an axis 36 generally in line with the handle 20 of the massager. An electric drive motor 38 is carried by bracket 34 and has a drive shaft 40 that is coupled to one end of the rocker element 32 by a link 42 via an eccentric drive 44 on the motor drive shaft. A switch 46 (visible in FIG. 1) is used for switching on and off motor 38.

Figure 6:
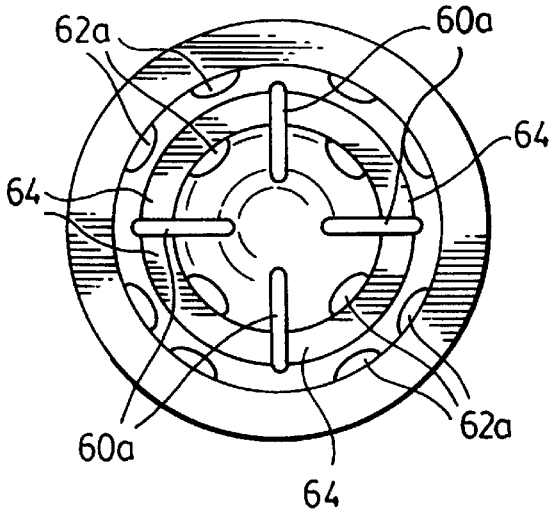
FIG. 6 is a view in the opposite direction to arrow A, showing the interior of the cover.
Figure 5:
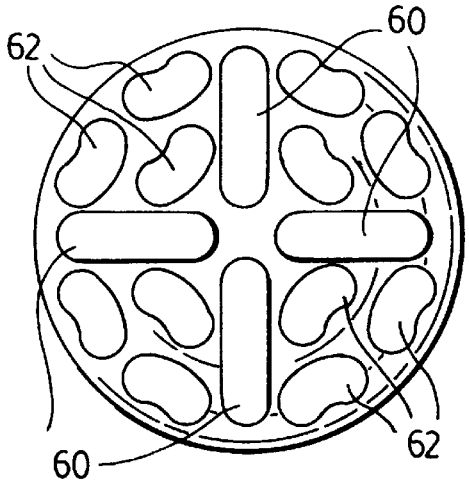
FIG. 5 is a view in the direction of arrow A in FIG. 4, showing the outer surface of the cover the massage formation.
Figure 4:
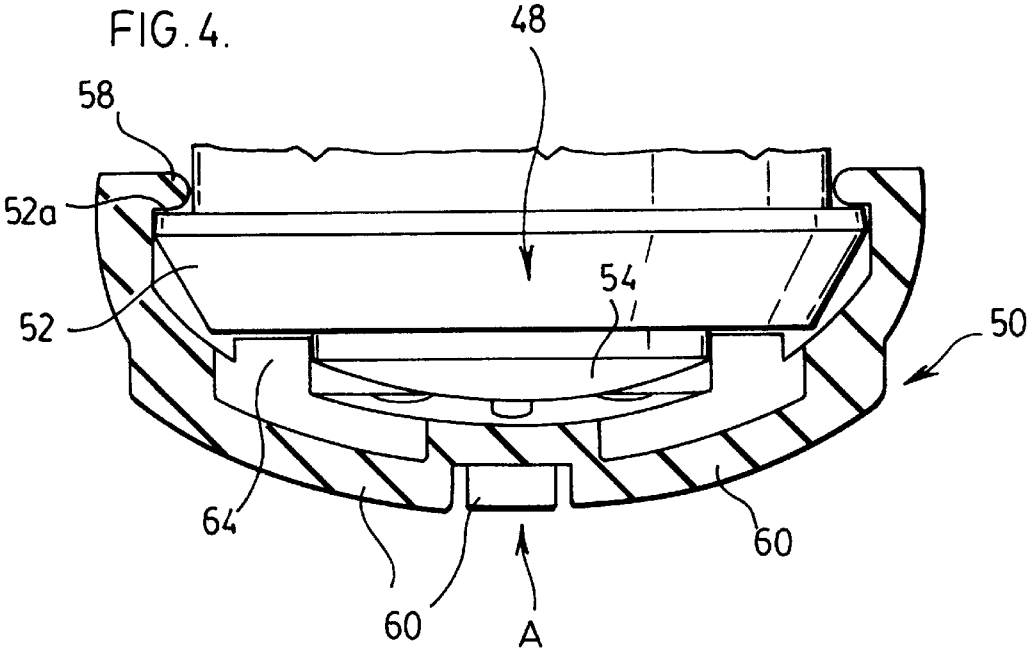
FIG. 4 is a vertical sectional view through one of the massage formations.
Figure 8:
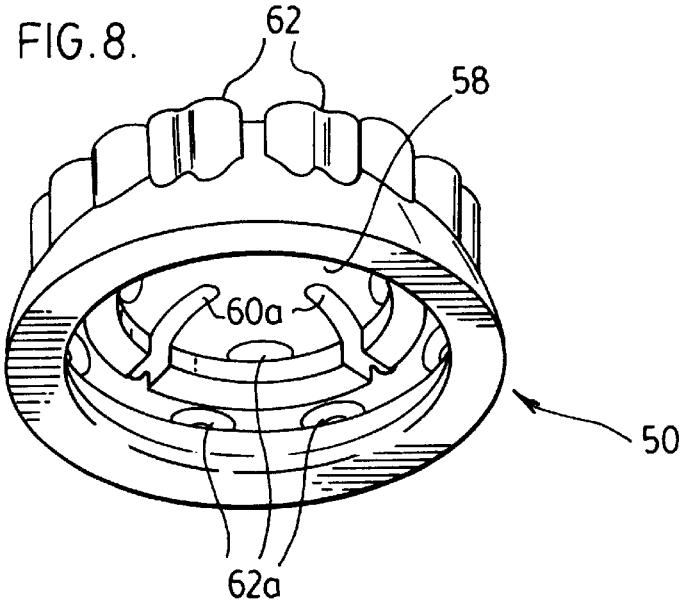
FIG. 8 is an internal perspective view of the cover shown in FIG. 7.

Rocker element 32 is a one-piece plastic moulding that is shaped to provide a pair of base elements 48 for the respective massage formations 26, on opposite sides of rocker pivot axis 36. One of those base elements is shown in side elevation in FIG. 4, and in perspective in FIG. 7. A cover of the massage formation is indicated at 50 and is shown in FIG. 4 fitted to the base element 48, and in FIG. 7 in an exploded position below base element 48. FIGS. 5 and 6 show respectively, the external and internal configuration of the cover, while FIG. 8 shows the cover as seen in perspective from the inside (i.e. as seen from above in FIG. 7).

Figure 7:
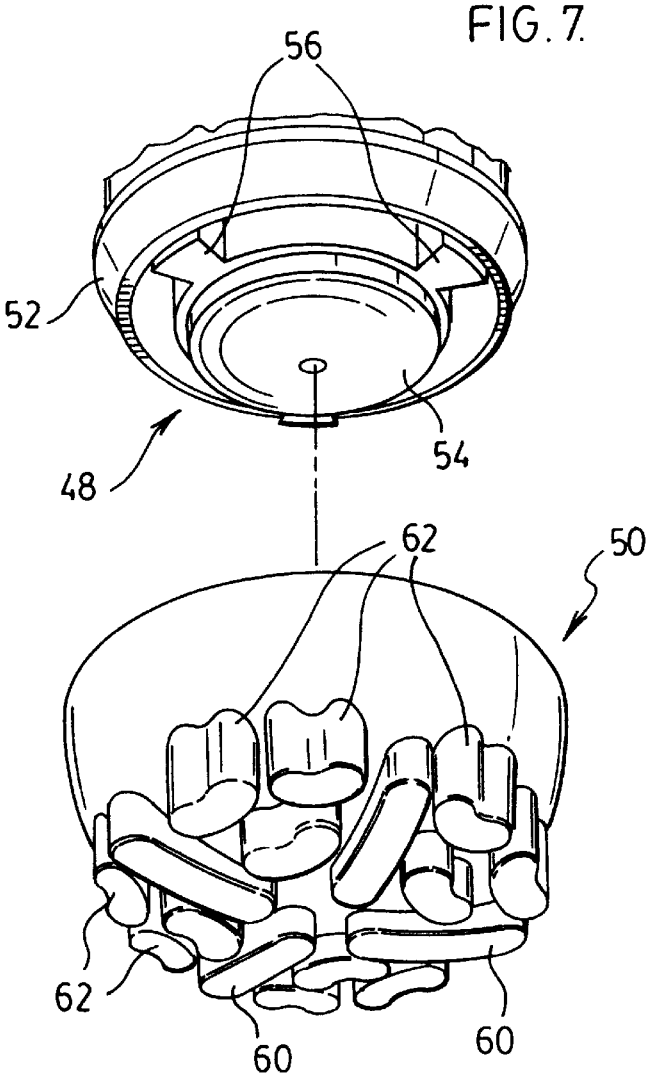
FIG. 7 is an exploded perspective view showing the cover and base element of the massage formation.

Referring first to FIG. 7, it will be seen that the base element 48 has a generally dome-shaped overall configuration, and comprises an outer annular portion 52 a domed central portion 54, with radial ribs 56 joining the two portions. The precise configuration of the base element is not believed to be important but the element probably should provide for a relatively large dome-shaped central portion, as portion 54, for provide a proper massage effect, coupled with a ledge around the perimeter of the element (portion 52) over which the cover 50 can be removably fitted. In FIG. 4, it can be seen that the outer annular portion 52 of the base element defines a ledge 52*a* over which engages an undercut annular rim or "bead" 58 of the cover.

Overall, the cover has a generally hemispherical "cup" shape with bead 58 extending inwardly around the rim of the cup. As indicated previously, the cover is made of a non-foam material such as PVC and has a wall structure that includes a plurality of cavities and intervening wall portions extending in the direction in which the massage head moves towards and away from a notional plane representing a surface to be massaged. In FIG. 3, that notional plane is indicated at N and the direction in which each massage formation moves towards and away from plane N is indicated by the arrow D (one for each formation).

It can be seen from FIG. 7 that the external surface of the cover 50 is contoured to provide an array of protrusions that extend outwardly from a generally dome-shaped "base" surface of the cover. As best seen in FIG. 5, the protrusions comprise four radially extending elongate protrusions 60 that are equally spaced about the external surface of the cover, defining four "quadrants" of the surface, and each quadrant includes a group of somewhat "kidney" shaped protrusions 62. The particular shapes and configuration of the array of protrusions is not believed critical in terms of massage effect, although it may be significant that the protrusions have some "height" (see FIG. 7) so that they can act to some extent as "fingers" that can flex during massage.

In any event, in this embodiment, the protrusions 60 and 62 are hollow in the sense that each protrusion has an internal cavity that extends into the internal surface of the cover as best seen in FIG. 6. The cavities corresponding to the protrusions 60 are denoted 60*a* and the cavities corresponding to the protrusions 62 are denoted 62*a*. In this case, the internal surface of the cover also includes a series of four internal ribs 64 that are of arcuate shape and are aligned with one another to in essence form an annular internal rib. When the cover is assembled to the base element 48 as shown in FIG. 4, this rib 64 fits around the central portion 54 of base element 48 for laterally locating the cover with respect to the base element.

Cover 50 is relatively flexible and can therefore be relatively easily "peeled" off the base element 48 by easing the bead 58 (FIG. 4) off ledge 52*a* at one location, and then working around the base element to free the complete cover. Installation of the cover of course requires a reverse action. An opening 48*a* (FIG. 7) in the base element avoids any air pressure effect that might inhibit installation or removal of the cover.

FIGS. 9 and 10 show an alternative form of cover within the scope of the invention. This cover is denoted 66 and is also made of PVC. In this case, however, the cover has a plain and smooth domed outer surface 68, and an array of internal cavities 70 and intervening wall portions 72 defined by an "egg crate" structure that is moulded into the internal surface of the cover as best seen in FIG. 10.

Again, the particular shape, configuration and arrangement of the cavities 70 is not believed critical. For example, the cavities could be cylindrical in shape. The size of the cavities and the thickness of the intervening wall portions can be varied according to the desired resiliency effect. The surface of the "egg crate" that co-operates with the base element 48 can also be contoured to follow the contour of the base element (e.g. recessed in the centre region).

A bead or lip 58' is provided around the rim of the cover as in the previous embodiment.

Whatever form the cavities and wall portions take, the principle is that the cavities and wall portions extend in the direction in which the respective massage formation moves towards and away from the massage surface when the massager is in use (D—in FIG. 3), so that the wall portions deform and restore during massage for providing resiliency.

As indicated previously, a single massager can be provided with a set of massage formation covers having different resiliency characteristics so that the covers can be changed from time to time to provide different massage characteristics. For example, a massager of the form shown in FIG. 1 could be provided with a set of covers comprising a pair of the covers as shown in FIGS. 4 to 8 and a pair of the covers shown in FIGS. 9 and 10.

It will of course be appreciated that the preceding description and accompanying drawings refer to a particular preferred embodiment of the invention, and that details may vary. Some variations have been described previously and others will be apparent to a person skilled in the art. The cover could be permanently attached to the base element of the massage formation. Another possibility is for the base element and cover (whether removable or not) to form a unit that could be supplied separately for attachment to a rocker element of a massager, e.g. using VELCRO™ or other separable attachment means.

It should also be emphasized that the design of the massage cavities and wall portions that have been shown in the drawings are examples only and are not intended to be limiting. Similarly, while the invention has been illustrated in the context of a massager of the form shown in U.S. Pat. No. 5,716,332, the invention may be applied to any form of percussive massager having at least one hemispherical massage formation.

I claim:

1. A body massager comprising:

a base structure that includes at least one handle for permitting the massager to be held by a user and manipulated in use;

a massage head for providing percussive massage and including at least one massage formation of generally hemispherical form, the massage head being coupled to the base structure for permitting movement of the massage formation in a direction towards and away from a notional plane representing a surface to be massaged, for exerting a percussive massage effect; and, drive means acting between said base structure and said massage head and operable to cause said movement of the massage formation;

wherein said massage formation comprises a base element having an outer surface that moves towards and away from said notional plane when the drive means is operated, and a cover which is coupled to the base element so as to extend over said outer surface, said cover being made of a non-foam material forming a generally dome-shaped outer surface and an opposite inner surface, said cover further having a wall structure that includes a plurality of cavities and intervening wall portions located at said inner surface extending in said direction in which the massage formation moves towards and away from said notional plane, whereby said wall portions deform and restore during massage, for providing resiliency of the massage formation.

2. A massager as claimed in claim 1, wherein said cover is coupled to the base element so as to be removable from the base element and replaceable onto the base element.

3. An massager as claimed in claim 2, in combination with at least two sets of said covers having respectively different configurations of said cavities and intervening wall portions providing different resiliency characteristics, the covers being interchangeable on said base elements.

4. A massager as claimed in claim 1, wherein said non-foam material from which the cover is made is polyvinyl chloride.

5. A massager as claimed in claim 1, wherein said cover has an external surface provided with a plurality of protrusions, at least some of which are hollow, for providing said plurality of cavities, said cavities extending to the interior of the cover.

6. A massager as claimed in claim 5, wherein said protrusions include four elongate protrusions that extend generally radially of the outer surface of the cover, defining four quadrants of said surface, and groups of secondary protrusions in said quadrants.

7. A massager as claimed in claim 1, wherein said cover has a smooth dome-shaped outer surface.

8. In a body massager having a base structure that includes at least one handle for permitting the massager to be held by a user and manipulated in use, a massage head for providing percussive massage and including at least one massage formation of generally hemispherical form, the massage head being coupled to the base structure for permitting movement of the massage formation in a direction towards and away from a notional plane representing a surface to be massaged, for exerting a percussive effect, and drive means acting between the base structure and the massage head and operable to cause said movement of the massage formation;

the improvement wherein said massage formation comprises a base element having an outer surface that moves towards and away from said notional plane when the drive means is operated, and a cover which is coupled to the base element so as to extend over said outer surface, said cover being made of a non-foam material forming a generally dome-shaped outer surface and an opposite inner surface, said cover further having a wall structure that includes a plurality of cavities and intervening wall portions located at said inner surface extending in said direction in which the massage formation moves towards and away from said notional plane, whereby said wall portions deform and restore during massage, for providing resiliency of the massage formation.

9. A body massager comprising:

a base structure that includes at least one handle for permitting the massager to be held by a user and manipulated in use;

a massage head for providing percussive massage and including at least one massage formation of generally hemispherical form, the massage head being coupled to the base structure for permitting movement of the massage formation in a direction towards and away from a notional plane representing a surface to be massaged, for exerting a percussive massage effect; and, drive means acting between said base structure and said massage head and operable to cause said movement of the massage formation;

wherein said massage formation comprises a base element having an outer surface that moves towards and away from said notional plane when the drive means is operated, and a cover which is coupled to the base element so as to extend over said outer surface, said cover having a smooth dome-shaped outer surface and being made of a non-foam material, the cover having a wall structure that includes a plurality of cavities and intervening wall portions at an inner side of the cover, said wall portions being arranged to define a rectangular grid having an egg-crate shaped appearance and extending in said direction in which the massage formation moves towards and away from said notional plane, whereby said wall portions deform and restore during massage, for providing resiliency of the massage formation.

* * * * *